US007921513B2

(12) United States Patent
Burnley

(10) Patent No.: US 7,921,513 B2
(45) Date of Patent: Apr. 12, 2011

(54) HINGE ASSEMBLY

(75) Inventor: Michael Burnley, Bowral (AU)

(73) Assignee: Taco Metals Inc., Miami, FL (US)

( * ) Notice: Subject to any disclaimer, the term of this patent is extended or adjusted under 35 U.S.C. 154(b) by 0 days.

(21) Appl. No.: 12/326,996

(22) Filed: Dec. 3, 2008

(65) Prior Publication Data

US 2009/0139054 A1 Jun. 4, 2009

Related U.S. Application Data

(60) Provisional application No. 60/991,817, filed on Dec. 3, 2007.

(51) Int. Cl.
*E05D 7/00* (2006.01)

(52) U.S. Cl. ..... 16/224; 16/268; 403/122

(58) Field of Classification Search ..... 16/224, 16/260, 268; 403/122, 56, 90
See application file for complete search history.

(56) References Cited

U.S. PATENT DOCUMENTS

| | | | | | |
|---|---|---|---|---|---|
| 576,131 | A | * | 2/1897 | Koennenmann | 16/224 |
| 797,185 | A | * | 8/1905 | Diehl | 16/268 |
| 797,186 | A | * | 8/1905 | Diehl | 294/15 |
| 834,928 | A | * | 11/1906 | Neilson | 16/224 |
| 2,732,581 | A | * | 1/1956 | Heck | 220/840 |
| 3,476,466 | A | * | 11/1969 | Hopkins | 351/115 |
| 7,461,995 | B2 | | 12/2008 | Burnley | |

* cited by examiner

*Primary Examiner* — William L. Miller
(74) *Attorney, Agent, or Firm* — Robert M. Schwartz; Alfred K. Dassler

(57) ABSTRACT

A hinge assembly includes a first plate member having a ball and a stem connected to the ball. A second plate member has a socket retainer for receiving and securing the ball therein. The second plate member has a channel formed therein for receiving the stem.

4 Claims, 8 Drawing Sheets

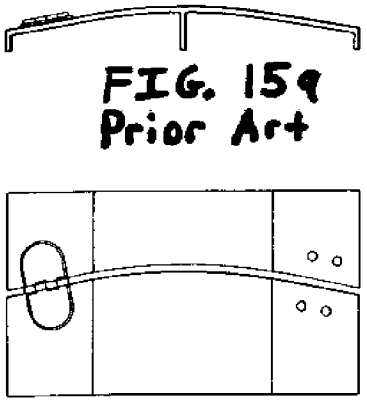
FIG. 15a
Prior Art
FIG. 15
Prior Art
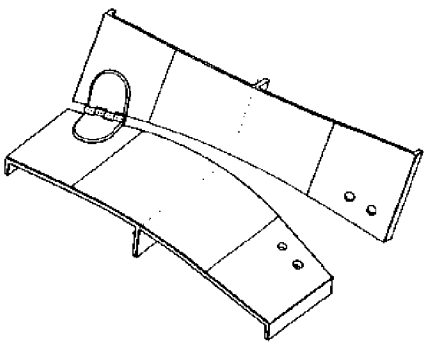
FIG. 16
Prior Art
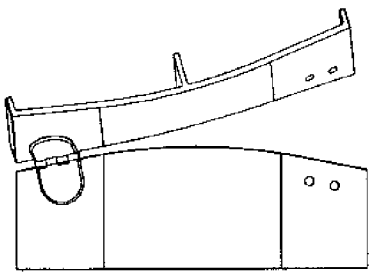
FIG. 17
Prior Art

HINGE ASSEMBLY

CROSS-REFERENCE TO RELATED APPLICATIONS

This application claims the benefit of U.S. Provisional Application Ser. No. 60/991,817, filed on Dec. 3, 2007, 2005, entitled Hinge Assembly, the prior application is herewith incorporated by reference in its entirety.

BACKGROUND OF THE INVENTION

Field of the Invention

The present invention pertains to a hinge assembly for attaching a door or cover having a curved edge along a side of the door that is to be hinged. The hinge assembly includes hinges mounted to opposite ends of the curved edge. This is not possible with conventional hinges because conventional hinges have a fixed axis of rotation and when disposed on opposite ends of a curved edge, the axes of rotation do not align with one another.

SUMMARY OF THE INVENTION

It is accordingly an object of the invention to provide a hinge assembly, which overcomes the above-mentioned disadvantages of the heretofore-known devices of this general type and which provides a hinge assembly that is suitable for a curved edge and easier to use.

With the foregoing and other objects in view there is provided, a hinge assembly which includes a first plate member having a ball and a stem connected to the ball. A second plate member has a socket retainer for receiving and securing the ball therein. The second plate member has a channel formed therein for receiving the stem Although the invention is illustrated and described herein as embodied as a hinge assembly for mounting a door having a curved edge, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 15 is a plan view of a conventional hinge assembly according to the prior art mounted along a curved edge of a door, when the door is in a closed planar position;

FIG. 15*a* is a side view of FIG. 15 showing a conventional hinge assembly according to the prior art;

FIG. 16 is a perspective view of a conventional hinge assembly according to the prior art mounted along a curved edge of a door, when the door is in an open position;

FIG. 17 is another perspective view of a conventional hinge assembly according to the prior art mounted along a curved edge of a door, when the door is in an open position;

DESCRIPTION OF THE PREFERRED EMBODIMENTS

Figure 1:
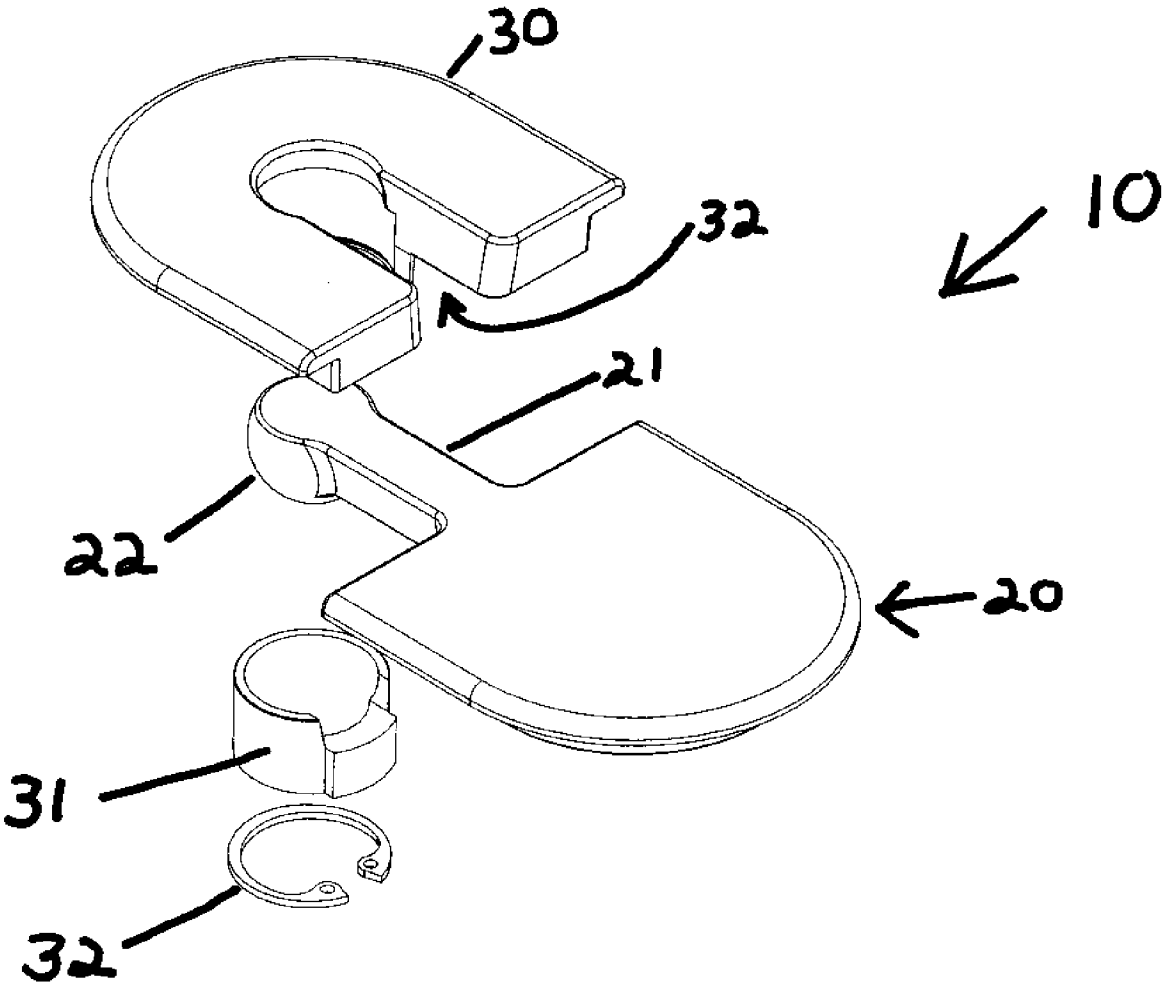
FIG. 1 is a perspective exploded view of a first embodiment of a hinge assembly according to the invention.
Figure 2:
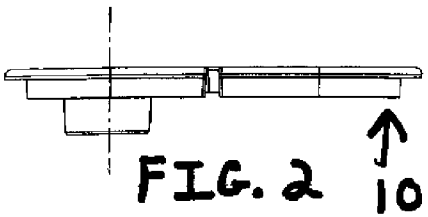
FIG. 2 is a side view of the first embodiment of the hinge assembly, according to the invention.
Figure 3:
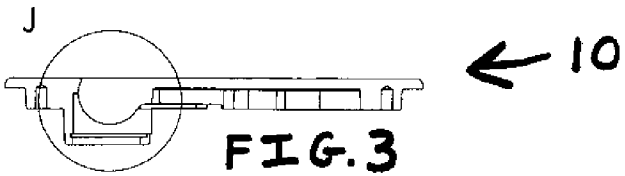
FIG. 3 is section view of the first embodiment of the hinge assembly, according to the invention.
Figure 4:
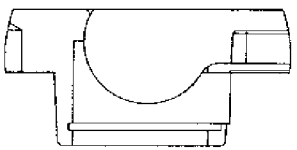
FIG. 4 is an enlarged partial section view of the area "J" in FIG. 3 of the hinge assembly, according to the invention.
Figure 5:
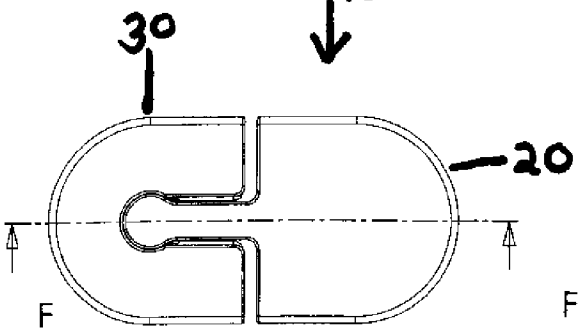
FIG. 5 is a top plan view of the first embodiment of the hinge assembly, according to the invention.
Figure 6:
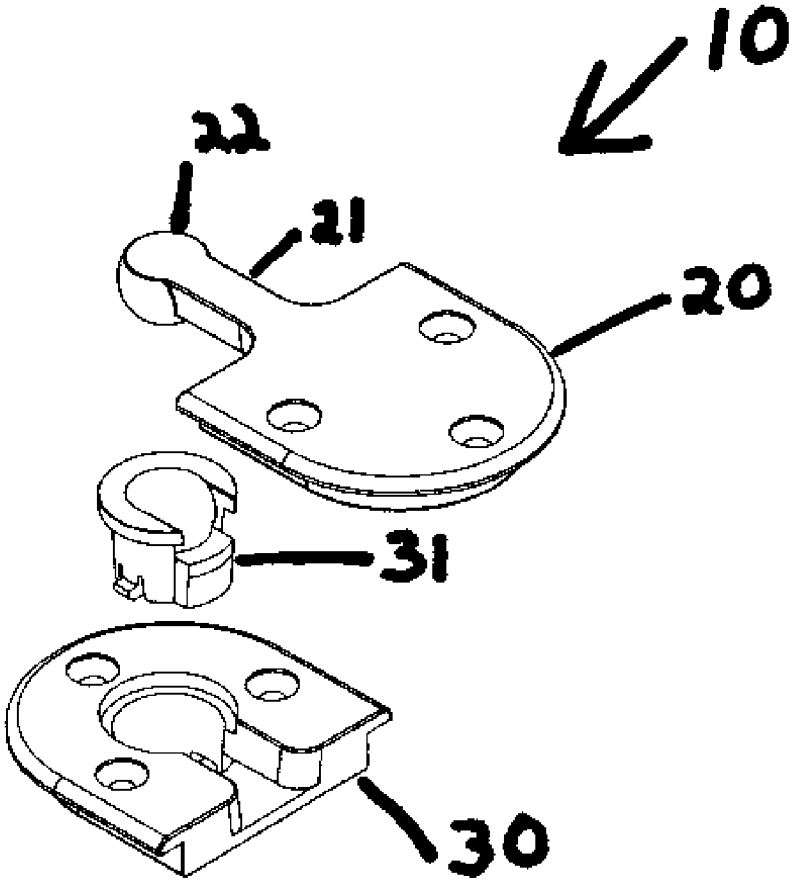
FIG. 6 is a perspective exploded view of a second embodiment of a hinge assembly according to the invention.
Figures 7, 8, 9, 10, 11, 12:
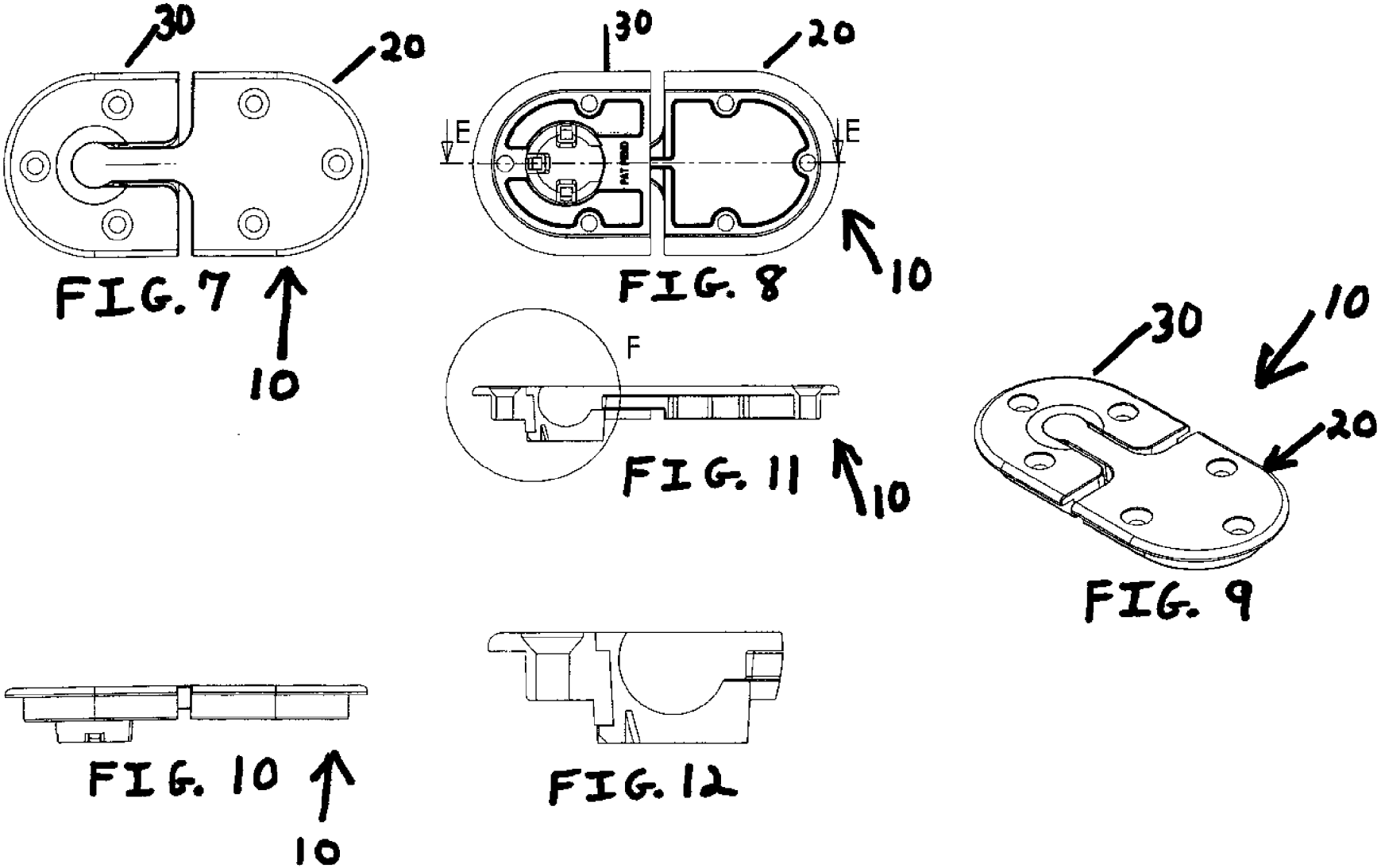
FIG. 7 is a top plan view of the second embodiment of the hinge assembly, according to the invention.
FIG. 8 is a bottom plan view of the second embodiment of the hinge assembly, according to the invention.
FIG. 9 is a perspective view of the second embodiment of a hinge assembly according to the invention.
FIG. 10 is a side view of the second embodiment of the hinge assembly, according to the invention.
FIG. 11 is section view of the second embodiment of the hinge assembly, according to the invention.
FIG. 12 is an enlarged partial section view of the area "F" in FIG. 11 of the hinge assembly, according to the invention.
Figure 13:
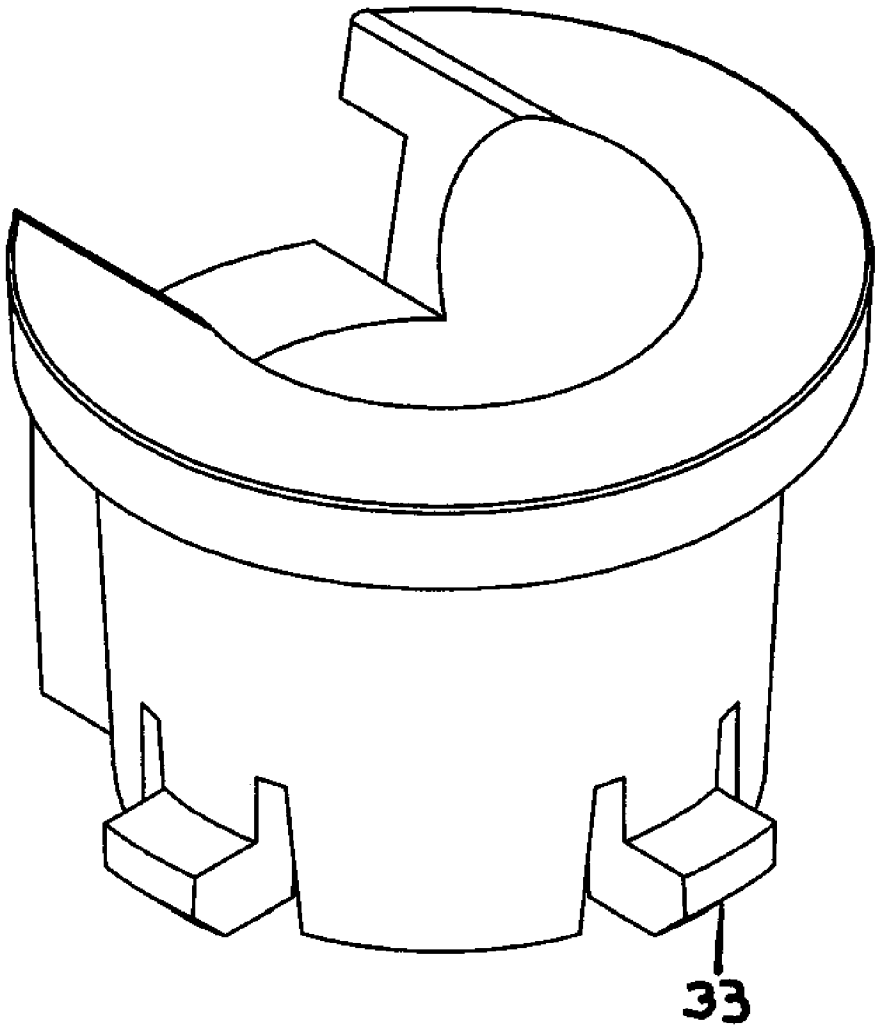
FIG. 13 is an enlarged perspective view of a socket retainer of the second embodiment of a hinge assembly according to the invention.
Figure 14:
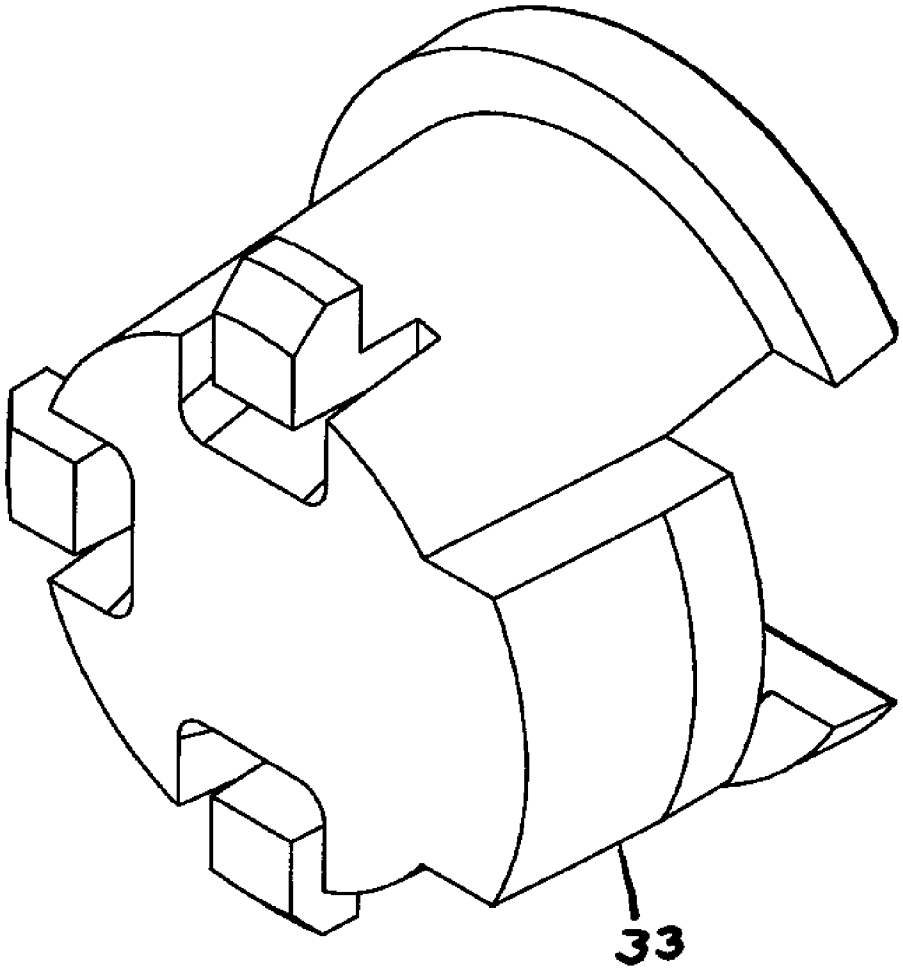
FIG. 14 is another enlarged perspective view of the socket retainer of the second embodiment of a hinge assembly according to the invention.

Referring now to the figures of the drawing in detail and first, particularly, to FIGS. 1-12, which illustrate a hinge assembly 10. The hinge assembly 10 includes a first planar plate member 20 having a stem 21 with a ball 22 mounted on the end of the stem 21, the stem 21 is attached to a main body portion at its opposite end. The hinge assembly 10 also includes a second planar plate member 30 having a socket retainer 31 for receiving and securing the ball 22. The planar member 30 has a channel 32 for allowing the stem 21 to pass through the second planar member 30 when the ball 22 is secured in the socket retainer 31. The socket retainer 31 may be mounted in the second planar member by a spring clip 33, or by tabs or hooks 33 formed directly on the socket retainer 31.

The prior art FIGS. 15-17 show a single conventional hinge mounted to a curved surface of a door. As is seen in FIGS. 16 and 17 when the door is opened, the opposite side of the door pulls away from the corresponding mounting piece (due to the curvature of the door). Therefore, a conventional hinge mounted on the opposite side of the door would not allow the door to be opened. This is due to the fact that a conventional hinge has a fixed rotational axis.

Figure 23:
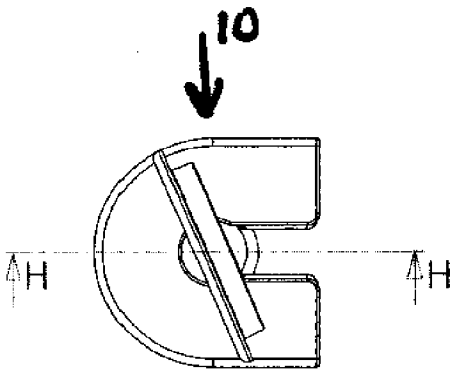
FIG. 23 is an enlarged perspective view of the hinge assembly, according to the invention when the hinge is mounted along a curved surface and opened.
Figure 18:
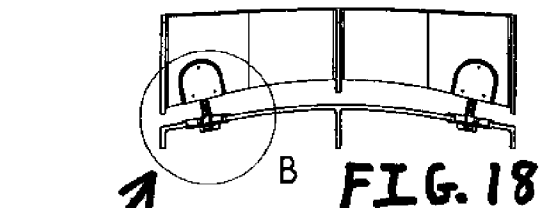
FIG. 18 is a side view of the of a pair of hinge assemblies according to the invention mounted along a curved edge of a door, when the door is in an open position.
Figure 21:
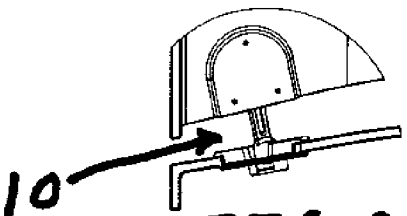
FIG. 21 is an enlarged partial view of the area "B" in FIG. 18 of the hinge assembly, according to the invention.
Figure 22:
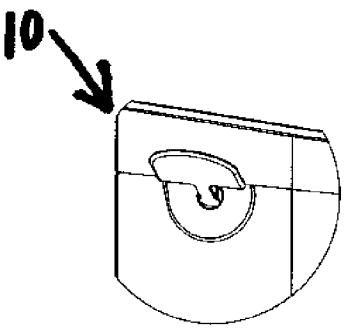
FIG. 22 is an enlarged partial view of the area "A" in FIG. 20 of the hinge assembly, according to the invention.
Figure 19:
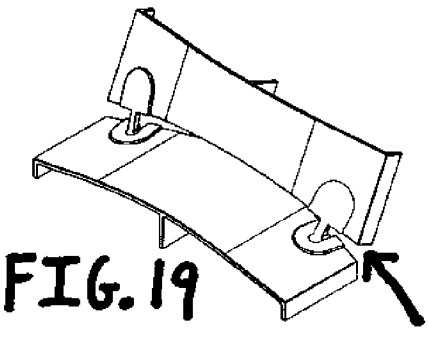
FIG. 19 is a perspective view of the of a pair of hinge assemblies according to the invention mounted along a curved edge of a door, when the door is in an open position.
Figure 20:
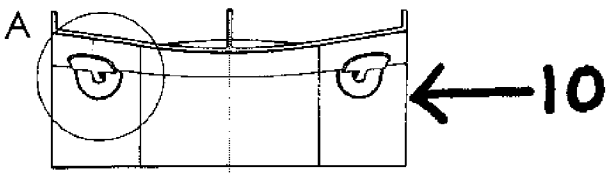
FIG. 20 is a top plan view of the of a pair of hinge assemblies according to the invention mounted along a curved edge of a door, when the door is in an open position.

FIGS. 18-20 show two of the hinge assemblies 10 according to the present invention mounted along a curved edge of a door. As seen the construction of the hinge assembly 10 allows the door to be opened when hinge assemblies 10 are present on opposite ends of the curved surface of the door and the mating structural component. FIG. 23 shows that the hinge assembly is able to function due to the fact that the ball 21 is free to move in with a circular motion as shown.

I claim:

1. A hinge assembly comprising:

a first plate member having a plate area, a ball, and a stem disposed between said ball and said plate area, said first plate member having a planar side surface defining a planar side of said plate area, said ball, and said stem;

a second plate member having a second plate planar surface and a socket retainer connected to said second plate member for receiving and securing said ball therein, said second plate member having a channel formed therein through said second plate planar surface for receiving said stem.

2. The hinge assembly according to claim 1, wherein when said hinge assembly is positioned so that longitudinal axes of said stem and said channel are parallel to one another, said planar side surface and said second plate planar surface are substantially co-planar.

3. The hinge assembly according to claim 2, wherein said socket retainer includes tabs formed thereon for fixing said socket retainer to said second plate member.

4. The hinge assembly according to claim 2, wherein said socket retainer is fixed to said second plate member by a spring clip.

* * * * *